US008540192B2

(12) United States Patent
Basso et al.

(10) Patent No.: US 8,540,192 B2
(45) Date of Patent: Sep. 24, 2013

(54) METHOD AND APPARATUS FOR OPERATION OF RAILROAD PROTECTION INSTALLATION

(75) Inventors: Klaus Basso, Peine (DE); Christoph Kutschera, Bad Harzburg (DE); Thomas Schmidt, Braunschweig (DE)

(73) Assignee: Siemens Aktiengesellschaft, Munich (DE)

( * ) Notice: Subject to any disclaimer, the term of this patent is extended or adjusted under 35 U.S.C. 154(b) by 210 days.

(21) Appl. No.: 13/054,596

(22) PCT Filed: Jul. 2, 2009

(86) PCT No.: PCT/EP2009/058294

§ 371 (c)(1),
(2), (4) Date: Mar. 15, 2011

(87) PCT Pub. No.: WO2010/006926

PCT Pub. Date: Jan. 21, 2010

(65) Prior Publication Data

US 2011/0155863 A1 Jun. 30, 2011

(30) Foreign Application Priority Data

Jul. 15, 2008 (DE) ..... 10 2008 033 712

(51) Int. Cl.
*B61L 29/32* (2006.01)
*B61L 23/00* (2006.01)

(52) U.S. Cl.
USPC ..... 246/293; 246/473.1; 246/292; 246/122 R; 246/114 R; 701/19

(58) Field of Classification Search
USPC ..... 246/293, 125, 294, 295, 296, 473.1, 246/127, 297, 167 A, 126, 292, 122 R, 114 R, 246/114 A, 111, 113, 115, 117, 118, 119; 701/19, 20
See application file for complete search history.

(56) References Cited

U.S. PATENT DOCUMENTS 6,241,197 B1 * 6/2001 Harland ..... 246/293

FOREIGN PATENT DOCUMENTS

| | | | |
|---|---|---|---|
| AT | 503852 | A4 | 1/2008 |
| DE | 43 08 237 | A1 | 9/1994 |
| DE | 196 53 729 | A1 | 6/1998 |
| EP | 0 979 765 | A2 | 2/2000 |
| EP | 1 101 684 | A1 | 5/2001 |
| WO | 00/76829 | A1 | 12/2000 |
| WO | 2006/125595 | A1 | 11/2006 |
| WO | 2009/100292 | A1 | 8/2009 |

OTHER PUBLICATIONS

Asbrock, et al. "Solar-Anrückmelder über Funk", Signal + Draht, Feb. 8, 2008, pp. 36-39, vol. 100, No. 1/2, Telzlaff Verlag GmbH, Germany.

* cited by examiner

*Primary Examiner* — Mark Le
(74) *Attorney, Agent, or Firm* — Laurence A. Greenberg; Werner H. Stemer; Ralph E. Locher

(57) ABSTRACT

A method and a device operate a railroad security system having trackside devices for specific functions. In order to reduce the number of cable connections, control of a first trackside device is provided by a data message generated as required by a second trackside device, in particular a signal box, the data message being transmitted wirelessly.

1 Claim, 1 Drawing Sheet

METHOD AND APPARATUS FOR OPERATION OF RAILROAD PROTECTION INSTALLATION

BACKGROUND OF THE INVENTION

Field of the Invention

The invention relates to a method and an apparatus for operation of a railroad protection installation, which has track-section devices for specific functions. These functions relate in particular to switching-on operations, for example on approach signaling means, switching operations, for example of railroad switches or monitoring devices, for example by means of light signals.

The following description relates essentially to the operation of an approach signaling means, although the invention is not intended to be restricted to this specific application.

Approach signaling means are used to determine a switching-on time for a railroad crossing protection device which is controlled by a signal box. The railroad crossing is normally protected by a main signal which must not signal free movement until the railroad crossing protection device has been activated, that is to say when traffic is prevented from crossing the track section. Without additional switching-on criteria, railroad crossing protection devices would therefore be switched on by the signal box with the stopping of the roadway, and would remain in the safe state until the roadway was clear. As a consequence of this, the crossing traffic would be stopped for an unnecessarily long time. In order to ensure that the railroad crossing protection installation is switched on at the correct time, approach signaling is therefore used as an additional criterion. An approach signaling means is used for this purpose which uses sensors to detect a rail vehicle moving past and signals via cables laid in the ground to the signal box, which then switches on the railroad crossing protection device. The approach signaling means is in this case positioned adjacent to the track section such that a rail vehicle requires a minimum approach time to the railroad crossing, which allows the main signal to be identified in good time by the engineer, with the separation between the main signal and the railroad crossing corresponding at least to the safe braking distance. This positioning allows the rail vehicle to be driven without being braked. The approach signaling means is frequently located several kilometers before the signal box, as a result of which special cables must be laid in the track bed in order to transmit the approach signaling information over long distances. This has the particular disadvantage of the high costs involved, which result in particular from the underground laying and regular maintenance of the cable ducts.

BRIEF SUMMARY OF THE INVENTION

The invention is based on the object of simplifying the operation of track-section devices for switching, and monitoring purposes, and in particular of making complex cable systems superfluous.

According to the method, the object is achieved in that a first track-section device is operated by a data message which can be transmitted without the use of cables and is generated by a second track-section device, in particular a signal box as required. For this purpose, the track-section devices have radio modules for transmitting and receiving function-relevant data messages.

The track-section device to be activated is operated via the data message from another track-section device, in particular a signal box, with the latter track-section device having the information relating to the approach of a rail vehicle. When the track-section device is activated by a signal box, the bus link which is normally present between adjacent signal boxes can be used to transmit the communication with the track-section device to be activated to another signal box. There is no need for extensive cable connections and underground work for the installation of appropriate cable ducts.

The invention further provides that the operation is carried out by activation of the track-section device at the appropriate time, wherein a data message which is generated in the signal box switches the track-section device from a standby mode to an active mode and, after carrying out its specific function, the track-section device sends a data message to the signal box, and is switched back to the standby mode. In this way, the track-section devices, which are networked by radio, are now activated, that is to say switched to be effective, only when required. The end of the activation after the specific functions of the track-section device have been carried out completely can either be carried out automatically by the track-section devices, or can be initiated from the signal box by a further data message to the track-section device that is to be switched back to the standby mode. The stimulus for switching to the active mode in good time is in this case produced by a signal box or some other track-section device when a rail vehicle starts from this track-section device in the direction of the track-section device to be activated.

Preferably, the process of switching to the active mode takes account of a delay time between a rail vehicle passing through, as detected by sensors, and the rail vehicle approaching the track-section device to be activated, depending on the maximum track-section speed. The time window in which the track-section device is operated in the active mode is therefore defined optimally. The delay time is configured in the signal box in accordance with the travel time to be expected to a point shortly before the track-section device to be activated.

Standby operation is particularly advantageous when the track-section device to be operated has current passed through it by a local power production device which is independent of a power supply system. By way of example, this may be a photovoltaic installation with a solar panel and battery. The energy consumption is minimized by the standby mode, as a result of which the local power production device can be designed cost-effectively even when the track conditions are poor. In the end, this therefore saves not only control lines between the track-section devices, but also power supply lines.

If the track-section device to be operated is an approach signaling means which is intended to determine the switching-on time of a railroad crossing protection device and is operated by means of a data message generated in a signal box, the data message switches the approach signaling means from a standby mode to an active mode after the end of a configurable delay time which starts when a rail vehicle enters a track-free signaling section which has the approach signaling means, that then the approach signaling means registers that the rail vehicle has moved past it and sends a data message relating to this to the signal box, in response to which the signal box switches on the railroad crossing protection device and produces a further data message which switches the approach signaling means back to the standby mode.

BRIEF DESCRIPTION OF THE SEVERAL VIEWS OF THE DRAWING

The invention will be explained in more detail in the following text using the example of approach signaling, and with reference to the illustrations in the figures, in which.

DESCRIPTION OF THE INVENTION

Figure 1:
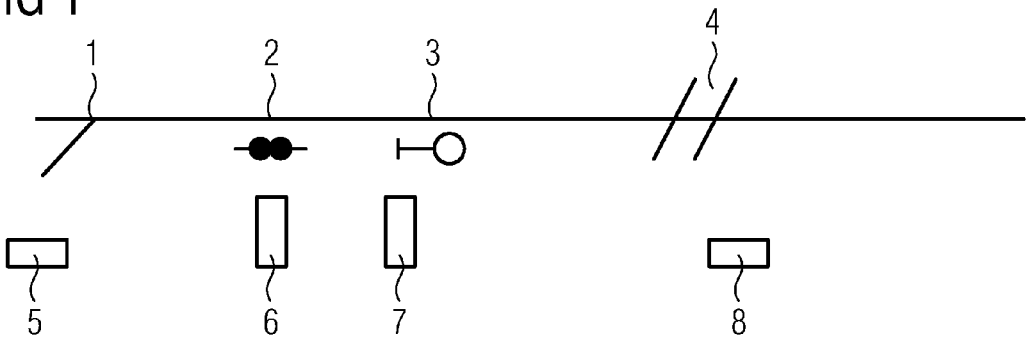
FIG. 1 shows a schematic illustration of various track-section devices.

FIG. 1 illustrates typical trackside components of a railroad protection installation, comprising a signal box 1, an approach signaling means 2, a main signal 3 and a railroad crossing protection device 4. These track-section devices 1 to 4 are each equipped with a radio module 5 to 8. The radio modules 5 to 8 are used to transmit and receive function-relevant data messages.

Figure 2:
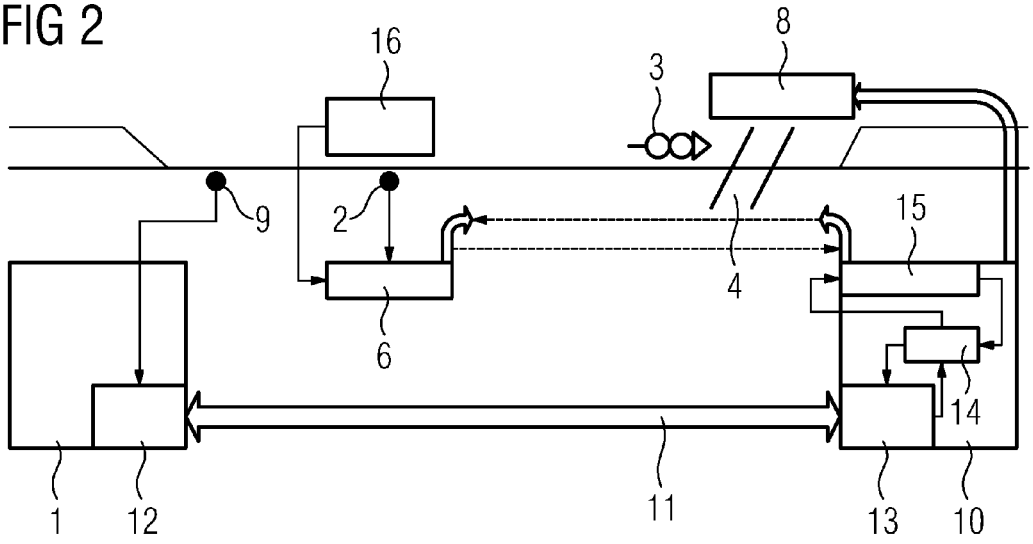
FIG. 2 shows the functional principle of approach signaling without any cables.

FIG. 2 provides a detailed illustration relating to the communication between the radio modules 5 to 8 of the track-section devices 1 to 4. As can be seen, the signal box 1 is connected to a track-free signaling sensor 9 at the start of the track section. A rail vehicle is registered by the signal box 1, when the roadway has been blocked, by a track-busy message from the track-free signaling section, which contains the approach signaling means 2. The signal box 1 is connected to a further signal box 10 in the vicinity of the railroad crossing protection device 4, via an optical waveguide bus 11. This bus link between area control computers 12 and 13 for the two signal boxes 1 and 10 is used, inter alia, to produce a command output in the signal box 10 after a configurable delay time has passed. The area control computer 13 in the signal box 10 then sets a relay output on a specific assembly 14 and can reset this again when there is no longer a requirement, specifically after transmission of the approach message, at any time again. A radio module 15 which is associated with the signal box 10 then sets up a radio link to the radio module 6 of the approach signaling means 2, and uses a specific data message to activate the monitoring function of the approach signaling means 2. When the approach signaling means 2 identifies that the approaching rail vehicle has moved past it, the approach signaling means 2 in turn generates a data message, which is sent via the radio module 6 of the approach signaling means 2 to the radio module 15 of the signal box 10. The receiving radio module 15 then operates a relay input on the assembly 14 and therefore generates a further data message which—precisely in the same way as in the case of the cable-based approach signaling means—is used as a criterion for switching on the railroad crossing protection device 4. There is therefore no longer any need to maintain the active mode of the approach signaling means 2 and, by setting a relay output of the assembly 14, this is converted to a further data message which is sent from the radio module 15 of the signal box 10 to the radio module 6 of the approach signaling means 2. This data message switches the approach signaling means 2 back from the active mode to the standby mode. The standby mode ensures low energy consumption, thus allowing current to be fed to the approach signaling means 2 from a local power supply device 16, in particular a photovoltaic installation.

The invention claimed is:

1. A method for operating a railroad protection installation having track-section devices for performing functions, which comprises the step of:

activating an approach signaling means, provided for determining a switching-on time for a railroad crossing protection device, upon reception of a first data message generated in a signal box, wherein the first data message activating a switching of the approach signaling means from a standby mode to an active mode after an end of a configurable delay time starting when a rail vehicle enters a track-free signaling section having the approach signaling means;

registering, via the approach signaling means, that the rail vehicle has moved passed the approaching signaling means and sending a second data message relating to the rail vehicle moving passed the approach signaling means to the signal box;

switching on, via the signal box, upon reception of the second data message, the railroad crossing protection device;

producing, via the signal box, a third data message for switching the approach signaling means back to the standby mode; and transmitting the first, second and third data messages without the use of cables.

* * * * *